US005254399A

United States Patent [19]

Oku et al.

[11] Patent Number: 5,254,399

[45] Date of Patent: Oct. 19, 1993

[54] NONWOVEN FABRIC

[75] Inventors: Yasuyuki Oku; Takeshi Yamasaki; Masanobu Matsuoka, all of Tokyo, Japan

[73] Assignee: Mitsubishi Paper Mills Limited, Tokyo, Japan

[21] Appl. No.: 808,925

[22] Filed: Dec. 18, 1991

[30] Foreign Application Priority Data

| | | | |
|---|---|---|---|
| Dec. 19, 1990 | [JP] | Japan | 2-412057 |
| Jan. 18, 1991 | [JP] | Japan | 3-019362 |
| Apr. 11, 1991 | [JP] | Japan | 3-108548 |
| Apr. 12, 1991 | [JP] | Japan | 3-108635 |

[51] Int. Cl.[5] ..... D04H 1/58

[52] U.S. Cl. ..... 428/288; 428/224; 428/296; 428/297; 428/299; 428/373; 428/397

[58] Field of Search ..... 428/224, 288, 296, 297, 428/299, 903, 373, 397

[56] References Cited

FOREIGN PATENT DOCUMENTS 0092819 4/1983 European Pat. Off. .
0171807 2/1986 European Pat. Off. .
0321237 6/1989 European Pat. Off. .
0326771 8/1989 European Pat. Off. .
2-6651 4/1990 Japan .

*Primary Examiner*—James J. Bell
*Attorney, Agent, or Firm*—Finnegan, Henderson, Farabow, Garrett & Dunner

[57] ABSTRACT

A nonwoven fabric having excellent sheet formation comprises fibers of which diameter is 7 μm or less and of which ratio of fiber length to fiber diameter (L/D) is in the range of $2000 < L/D \leqq 6000$, and optionally thermalbonding fibers, and the fibers being three-dimensionally entangled. A nonwoven fabric having excellent sheet formation comprises 10–90% by weight based on the weight of the nonwoven fabric of fibers of which diameter is 7 μm or less and of which L/D is 2000 or less, 90–10% by weight based on the weight of the nonwoven fabric of fibers of which diameter is 7 μm or less and of which ratio of fiber length to fiber diameter (L/D) is in the range of $2000 < L/D \leqq 6000$, and optionally thermalbonding fibers, the maximum pore size of the nonwoven fabric being 5 times the mean pore size or less, and the fibers being three-dimensionally entangled.

8 Claims, No Drawings

NONWOVEN FABRIC

BACKGROUND OF THE INVENTION

Field of the Invention

The present invention relates to a nonwoven fabric and a method for the production thereof, and more particularly, to a nonwoven fabric having a good sheet formation and other favorable characteristics and a method for production thereof.

SUMMARY OF THE INVENTION

An object of the present invention is to provide a nonwoven fabric having excellent sheet formation and exhibiting at least one of the following favorable characteristics; pleasing touch or handle, softness, good texture, excellent drape, high air permeability, and high strength.

Another object of the present invention is to provide a method of producing at higher productivity and at excellent fiber dispersion a nonwoven fabric on wet forming having excellent sheet formation and exhibiting at least one of the following favorable characteristics; pleasing touch or handle, softness, good texture, excellent drape, high air permeability, and high strength.

According to a first aspect of the present invention, there is provided a nonwoven fabric having good sheet formation which comprises fibers having a diameter of 7 μm or less, the ratio of fiber length L to fiber diameter D (L/D) being in the range of $2000 < L/D \leqq 6000$ and optionally thermalbonding fibers, and the fibers being three-dimensionally entangled.

According to a second aspect of the present invention, there is provided a non-woven fabric having good sheet formation which comprises fibers having a diameter of 7 μm or less, of which L/D is in the range of $2000 < L/D \leqq 6000$, in an amount of 10–90% by weight based on the weight of the nonwoven fabric; the maximum pore size of the fabric being 5 times the mean pore size or less, and the fibers being three-dimensionally entangled.

DESCRIPTION OF RELATED ART

Nonwoven fabrics have been recently used widely in various fields in place of woven or knitted fabrics.

Being low in cost and high in productivity, nonwovens may possibly be used as substitutes for conventional woven or knitted fabrics, or they may possibly further penetrate into new fields of use as functional fabrics since they can provide functions unattainable by conventional woven or knitted fabrics. Supply of nonwoven products to market places where pulp and papers have heretofore been used as raw material is also increasing nowadays taking advantage of their high functional performances.

Representative methods for making nonwoven fabrics include spunbonding method, melt-blow method, dry-laid method, needle punching method, spunlace method and wet-laid method, and each of these methods finds its niche as it fits, so that any one of them by itself can by no means cover overall ranges of nonwoven products.

Spunbonding method makes a fabric having high tensile and other strength characteristics, therefore are favored for industrial materials required to have high strength. However, bonding of the fiber integrity depends mainly on thermal compression so that resulting fabric is high in density, stiff, and poor in drape.

Melt-blow method makes a sheet of very fine fibers, but sheet formation is poor and cost is high due to low productivity.

Dry-laid method makes a web, by carding or air-laying, bulkier and more aesthetically pleasing as compared to aforesaid methods. The bulkiness and aesthetics have to go down, however, when the web is treated with binders or thermal compression for finishing in order to impart strength characteristics. Moreover, carding cannot be applied to fibers of which diameter is 7 μm or less; air laying can hardly, if not impossible, make a web in which long staple fibers are uniformly dispersed.

Nonwoven fabrics obtained by needle punching method or spun-lace method, which as disclosed in Japanese Patent Publication No. Sho 48-13749 (1973) employs jets of water to entangle a fibers of a fiber integrity primarily formed by carding, can form a web without using any binder and exhibits favorable texture and drape.

A drawback common to every of aforesaid methods, however, is poorer sheet formation as compared to same obtained by wet-laid method. Wet-laid method has various merits over aforesaid methods that productivity is high, that smaller diameter fibers can be made use of, that a web can be formed of a fiber furnish in which two or more kinds of fibers are mixed at any desired ratio, and that sheet formation is excellent.

On the other hand, wet-laid nonwovens according to ordinary wet-laid method have sustained a limitation in their field of use due to poorer strength characteristics; in order to disperse fibers uniformly in water and to obtain a good sheet formation, length of the fibers has to be short. If longer fibers are dared to be used, they tend to be entwisted each other forming fiber bundles and strings, and are hardly dispersed and laid uniformly.

In addition, since a web formed wet is pressed onto a Yankee or multicylinder dryer surface during drying process, or regardless of drying method (i.e. even when the web is dried by a through air dryer) but due inherently to use of shorter fibers and to their orientation in only two dimensional directions, resulting sheet is much like a paper and poor in drape; in particular, when very fine fibers are used resulting sheet is dense and poor in air permeability.

Japanese Patent Laid-open No. Hei 02-6651 disclosed wet-laid nonwoven and hydroentangled fabrics formed of fibers having a diameter of 7–25 μm and a ratio of length (L) to diameter (D), L/D, ranging 800–2,000 employing jets of pressurized water to attain three-dimensional fiber orientation.

This fabric should be of note since it has improved the poor strength properties of conventional wet-laid nonwovens attributable to use of shorter fibers. Said patent specification describes that length of fibers is required generally to be 3–7 mm, and it further describes that a nonwoven fabric obtained by processing the wet-laid web formed of 7 mm or longer fibers showed poor sheet formation. In this regard, the nonwoven fabrics under the art do not effectively utilize a merit of the wet-laid process, namely good sheet formation. Further, said relatively large fiber diameter, 7–25 μm, resulted in poor drape, unpleasing touch, and insufficient softness.

Japanese Patent Application Laid-Open No. Sho 54-27067 disclosed a method in which a ultra-fine synthetic filaments are bundled using a water-insoluble (or hardly water soluble) glue, then cut to a length 20 mm or shorter to make a kind of 'bundled staples' which in turn are wet-laid to form a sheet; the sheet in turn is laid on a knitted fabric and subjected to jets of pressurized water to effect entanglement, thereafter said glue is removed. According to this method said 'bundled staples' are dispersed seemingly, but only partially contribute to entanglement so that their original orientation is prevailing and resulting fabric as a whole is poor in sheet formation and touch.

Japanese Patent Application Laid-Open No. Sho 53-28709 disclosed a method in which a web containing bicomponent splittable fibers is hydroentangled to let them split and to let splitted component fibrils of them entangle. According to this method, unsplitted portions remain in the web resulting in nonuniform sheet formation and poor touch.

In view of the aforementioned drawbacks of the prior art, the present invention intends to provide hydroentangled nonwoven fabrics fully utilizing merits of wet-laid nonwoven process, e.g. good sheet formation, uniformity, and use of super-fine fibers, while improving drawbacks of the process, e.g. low strength properties, poor drape and texture, insufficient air permeability.

SUMMARY OF THE INVENTION

DESCRIPTION OF THE PREFERRED EMBODIMENTS

According to the first aspect of the present invention, there are used fibers having a diameter of 7 μm or less and a ratio of their length (L) to diameter (D), L/D, in the range of ones and they are three-dimensionally entangled to form nonwoven fabrics including spunlaced fabrics. The fiber furnish to make the fabrics may contain thermalbonding bicomponent fibers as binder fibers.

When the fiber diameter is greater than 7 μm, touch and softness of the resulting fabric becomes poorer as compared to one made of fibers having a diameter of 7 μm or less.

The fiber diameter is preferably 1-5 μm. When the fiber diameter is less than 1 μm, the fibers tend to be entwisted each other during dispersion step forming so-called fiber bundles and strings, which are in certain cases undesirable in forming a web of good formation. When the fiber diameter exceeds 5 μm, fiber length will go up to 30 mm or longer to meet said L/D criteria and such fibers are not easily dispersed in water.

When the L/D ratio is 2000 or lower, fibers entangle less and a desired three-dimensional entanglement effect to develop a level of strength is hardly attained. When the L/D ratio exceeds 6000, fibers are too long to be dispersed uniformly in water so that the resulting web is poor in sheet formation.

Uniform dispersion of fibers before web forming is very important. Long or slender fibers, of which L/D ratio does not fall within said range, may form a fabric good in strength and texture. However, unless they are uniformly dispersed before web forming the resulting three-dimensionally hydroengangled fabric is poorer in not only in uniformity but also in strength and texture than one formed of fibers falling within said L/D criteria and dispersed well in water prior to web forming.

The hydroentangled nonwoven fabrics of the present invention is composed of fibers having shorter length and much finer diameter than those constituting ordinary dry-laid and hydroentangled fabrics. According to the present invention, a precursor web has superb sheet formation, so that when the web is hydroentangled three-dimensional fiber entanglement is most effectively achieved resulting in a hydroentangled fabric having strength characteristics comparable with that of ordinary dry-laid and hydroentangled fabrics. In order to obtain such favorable effect, fibers having diameter of 1-5 μm and falling within said L/D range, $2000 < L/D \leqq 6000$, are preferred.

The fibers employed in the present invention include, organic synthetic fibers such as polyester fiber, polyolefin fiber, polyacrylonitrile fiber, polyvinyl alcohol fiber, nylon fiber, polyurethane fiber and the like, semisynthetic fibers, regenerated fibers, natural fibers and the like.

Some of the aforesaid fibers may be exemplified in the following;

(a) polyester fibers: those composed of polyethylene terephthalate, polybutylene terephthalate, modified polymers thereof or the like which may be a homopolymer or copolymer;

(b) polyolefin fibers: those composed of polypropylene, polyethylene, polystyrene, modified polymers thereof or the like which may be a homopolymer or copolymer;

(c) polyacrylonitirile fibers: those composed of acrylic or methacrylic polymers;

(d) nylon fibers: those composed of nylon 6, nylon 66 and the like;

(e) semisynthetic fibers: those composed of cellulose acetate;

(f) regenerated fibers: those composed of regenerated cellulose like rayon, those drafted and spinned from a solution of collagen, alginic acid, chitin, or the like; and (g) natural fibers: natural cellulose fibers like cotton, hemp and the like, natural protein fibers like wool, silk and the like.

Further, the fibers employed in the present invention—if they are chosen from synthetic fibers, may be composite, bicomponent or multi-component fibers composed of two or more of the aforesaid polymers; fiber cross section may be not only round or oval, but also a so-called 'bizarre' or 'trilobal' like shape resembling characters Y, T and U, or star, dogbone, and the like.

Two or more kinds of fibers may be employed in combination as long as they fall within said L/D criteria. Further, exceptional fibers which go outside the L/D range may be mixed into the fiber furnish as long as they do not adversely affect performance of the nonwoven fabric of the present invention.

As described heretofore, the nonwoven fabric of the first aspect of the present invention may additionally contain thermalbonding fibers as a binder. An embodiment under the aspect is a nonwoven fabric including spunlaced fabric, which contains fibers as main furnish having diameter 7 μm or less, preferably 1-5 μm, and falling within said L/D range, $2000 < L/D \leqq 6000$, and additionally thermalbonding fibers, and in which fibers are three-dimensionally hydroentangled.

The thermalbonding fibers used in the present invention are those containing low-melting point component. The fibers may comprises a polymer resin, e.g. polyester, polyethylene, polypropylene, polyamide, and the like. When a web containing this fiber is formed by a wet-laid former and is put into a dryer, it fuses by heat to bind fibers at intersecting points.

Two kind of the thermalbonding fibers are available. One is a single-component fiber which loses its fibrous structure at the time of fusing (bonding); the other comprises at least two components having different melting points.

The former changes to fluid or tacky film upon heating to achieve inter-fiber bonding. The bond is so firm that three-dimensional fiber entanglement in the later hydroentanglement step is blocked unless the binding resin is soluble to water. Furthermore, drape, touch, texture and air-permeability of the finished fabric are poor; inter-layer bond is poor as well and this may lead to peeling.

For reasons in the foregoing paragraph, the latter type thermalbonding fibers are preferred, in particular those having sheath-core structure composed of a high melting point component in the core and a low melting point component in the sheath. Difference between the high and low melting points is preferably 40° C. or more. The core and sheath arrangement may be concentric, or excentric where part of core is optionally exposed from sheath. Core/sheath component ratio preferably is 1/1–4/1 in volume. If the sheath component is greater than the core component, the thermalbonding fiber loses fibrous structure when heated and inter-fiber bond becomes so strong that it is not preferable in the same way as the single component thermalbonding fiber as explained earlier. On the other hand, when the sheath component is less than the aforesaid ratio, the sheet strength goes down so that greater amount of the thermalbonding fiber is required to retain the sheet integrity, thereby harmfully affecting performance of the nonwoven fabric of the present invention.

Material for the core and sheath components is preferably a polymer of the same type, but may be of a different type if they have affinity each other. This affinitive relationship applies also to same between the thermalbonding fibers and the main furnish fibers employed.

Amount of the thermalbonding fiber is preferably 1–20% by weight based on the nonwoven fabric. When the amount is less than 1%, strength of the web formed is low; when it is more than 20%, energy for hydroentanglement of fibers goes up, the web formed is stiff and texture of the resulting fabric becomes poor.

While fiber diameter and L/D ratio of the thermalbonding fiber fall preferably within said criteria for the main furnish fibers, use of a themalbonding fiber of which L/D ratio goes outside that range poses little problem as far as its amount is within said weight ratio range, its diameter 25 μm or less, and its length 3 mm or longer.

When length of the bicomponent fiber is shorter than 3 mm, strength of the web formed on a wet-laid former is low even though its amount in the furnish is raised to 20% by weight. Length of the fiber is preferably 3–mm in view of attaining the hydroentanglement effect; inter-fiber bond of the web achieved by the thermalbonding fiber may disengage at least partially when the web is subjected to pressurized water jets for entanglement, and there should be a lot of fibers having free ends capable of being entangled.

The nonwoven fabric of the first aspect of the present invention including spunlaced nonwoven fabric may be produced by the following steps.

A web is formed on a wet-laid former of a fiber furnish comprising fibers having diameter of 7 μm or less, preferably 1–5 μm, and length to diameter ratio (L/D) in the range of $2000 < L/D \leqq 6000$ and a water-soluble or hot water-soluble binder, and dried. One or more layers of the web are piled and high pressure water jets are applied on the pile for hydroentanglement, during the course of which said water-soluble binder is washed away and fibers in the pile are allowed to be entangled three-dimensionally.

In view of the relatively high L/D ratio of the fibers employed in the present invention, attention should be paid to the steps of disintegrating and dispersing (staple) fibers in water. A rotating impeller type unit may be used in these steps. Prior to disintegration, it is preferable to add a dispersing agent to water in which the (staple) fibers are disintegrated, or to immerse the fibers in a 1% solution of a dispersing agent.

Fibers are added gradually to water under a controlled agitation to make a fiber slurry, wherein if there is any mass of fibers not disintegrated completely agitation rate is raised with a jerk in order to give a shock to such unseparated fiber mass and to promote disintegration. Such raise in agitation rate should be just temporal, otherwise individual fibers become entwisted forming bundles and strings.

Dispersion takes place in continuation to disintegration, wherein the fiber slurry is kept under a moderate agitation to prevent coagulation, is diluted with water, and a viscosity modifier is added to it quickly. Throughout this step, agitation rate should be maintained as moderate as possible.

A binder is used to achieve inter-fiber bond. The binder may be water-soluble one, hot water-soluble one, or ones having fibrous structure, of which material is preferably polyvinyl alcohol but not limited thereto. It may be added, in a form of solution or aqueous dispersion (if it is fibrous one) to the fiber slurry before being laid; or, its solution may be applied by dip coating to a web formed. Both of these may be done in combination.

Amount of the binder is preferably 1–10% by weight based on the web formed on a wet-laid former. If the amount is less than 1%, strength of the web formed is too low to be handled and processed in later steps; if it exceeds 10%, inter-fiber bond develops so intense that very high hydraulic pressure is required for hydraulic entanglement.

The fiber slurry thus prepared is formed on a wet-laid former into a web, which in turn may be dried by an ordinary means using a Yankee dryer, multi-cylinder dryer, through air dryer, suction through dryer or the like. Since the present invention aims at obtaining a web having sheet formation as good as possible, fiber slurry concentration has to be low and vacuum at wet part has to be intense. While there is no limitation about basis weight of the web formed, it is preferably 70 $g/m^2$ or less in view of obtaining desirable sheet formation.

As a production system for producing the nonwoven fabric according to the present invention, an off-machine line is preferred. In order to control basis weight of a web on a former of an on-machine system, forming conditions (e.g. line speed) have to be varied so that it is difficult to supply a good formation web consistently to following hydroentanglement units incorporated in the on-machine system. In an off-machine system, a precursor web can be formed at a high speed and basis weight of a nonwoven fabric is controlled independently by adjusting number of the webs to be stacked. A wet laid-former can run at a speed as high as 500 m/min or higher, while a hydroentanglement processor can run at 100–200 m/min so that it will limit a line speed of an on-line system. Therefore, from productivity point of view, an on-line system is not advantageous.

In the present invention, relatively slender and thin fibers in terms of the diameter ($\leqq 7$ μm) and L/D ratio ($2000 < L/D \leqq 6000$) are used. Such fibers entangle easily in the hydroentanglement step so that they can make a nonwoven fabric having high strength characteristics. One or more sheets formed by a wet-laid former are stacked into a pile, which in turn is hydraulically needled to effect fiber entanglement.

In order to create fine, high-velocity, columnar streams of water, effecting desired entanglement while maintaining good sheet formation, diameter of small holes creating the streams is preferably 10–500 μm and hole-to-hole distance is preferably 10–1500 μm.

A jet header in which a number of small holes are driven is set perpendicular to the direction of fabric travel and should cover throughout width of fabric being processed. Number of the jet headers to be placed in series along machine direction to attain sufficient entanglement may be variable depending on kind of a fabric to be processed, its basis weight, processing speed, and water pressure.

Water pressure is preferably 10–250 Kg/cm$^2$, more preferably 50–250 Kg/cm$^2$, and processing speed 5–200 m/min. When the pressure is low, sufficient entanglement can not be attained; when the pressure is excessively high, sheet formation or uniformity of the fabric may suffer damage, or the fabric may be destroyed. Water pressure can be raised stepwise from the first to the last jet header, so that intensive entanglement is effected without degrading surface integrity of the fabric. Diameter or population of holes can be decreased stepwise from the first to the last jet to improve surface quality of the fabric. Furthermore, a jet header can be rotated or oscillated, or a wire cloth conveying the fabric is oscillated to further improve the surface quality. Still another method to polish surface integrity is to insert a 40–100 mesh wirecloth between an already entangled fabric and a jet header in order to mute water streams or spray onto the fabric.

A fabric can be hydroentangled on only one side, or on both sides. A fabric once needled can be stacked with another sheet(s) and can be needled again.

A pile of sheets prepared under the first aspect of the present invention contains a water-soluble binder component prior to entanglement. Most of the binder component is washed during entanglement process. When water streams are weak, or entire removal of the binder component is required, the pile of sheet can be put through hot water either before or after the entanglement step to further extract the component.

As mentioned earlier, sheet formation of precursor web influences significantly upon uniformity and formation of the resulting hydroentanged nonwoven fabric. In order to obtain a web having good sheet formation, concentration of fiber slurry to be fed to a wet-laid former is preferably as low as possible. A relatively low basis weight precursor web can be easily formed of such low concentration fiber stock. That web is made to contain a water-soluble or hot water-soluble binder; the precursor web is then stacked and hydraulically entangled to make a nonwoven fabric excellent in uniformity and sheet formation.

It goes without saying that a dry-laid nonwoven, pulp sheet, or a wet laid sheet comprising fibers other than those specified earlier can be stacked on a side, both sides or inbetween, and can be hydroentangled on a side or both. Needless to say, such variation is authorized only to an extent that the purposes of the present invention are fulfilled.

The hydraulically needled and three-dimensionally fiber entangled fabric thus prepared is squeezed by vacuuming or pressing to remove water, and dried by an air dryer, a through air dryer, a suction through dryer, or the like. In drying, a type of dryer that causes little compression of the fabric in Z-direction is preferred.

The thus obtained hydroengangled nonwoven fabric according to the present invention may further receive some other physical or chemical treatment like folding, stretching, craping, resin impregnation, water wetting or repelling treatment, and the like, to provide a variety of special functions.

The nonwoven fabric of the first aspect of the present invention, for instance spunlaced nonwoven fabrics, containing thermalbonding fibers may be produced by the following steps.

A web is formed on a wet-laid former of a fiber furnish comprising fibers having diameter of 7 μm or less, preferably 1–5 μm, and length to diameter ratio (L/D) in the range of $2000 < L/D \leqq 6000$ and thermalbonding fibers, and dried. By virtue of heat applied in the drying step, low melting point component of the thermalbonding fibers fuses to bind fibers at intersecting points. One or more layers of the web thus formed are piled and high pressure water jets are applied on the pile and fibers in the pile are allowed to entangle three-dimensionally. The fiber sheet thus entangled is drained.

The production process is similar to that for producing the nonwoven fabric not containing thermalbonding fibers of the first aspect of the present invention as described earlier except that thermalbonding fibers are used. Some mentions, however, should be made as follows in complement.

If the thermalbonding fibers employed as binder fibers have diameter and L/D ratio that fall within said criteria of the main furnish fibers, both of them are preferably disintegrated and dispersed together and simultaneously. If L/D ratio of the binder fibers is low, therefore require no special care about dispersion, then they may be added at any timing in the fiber furnish preparation steps.

There is no limitation about basis weight of the web to be formed, but it is preferably 70 g/m$^2$ or less after drying in view of obtaining a desirable sheet formation.

Fibers in the precursor web is bound by the binder fibers, but there are a lot of cut ends or portions of fibers not bound at intersecting points. As long as amount of the binder fibers in the furnish is within a range of 1–20% by weight, a lot of fibers are released by high pressure water jets in the hydraulic entanglement step from binding intersectional points, and are entangled three dimensionally together with such ends and unbound portions. During the hydraulic entanglement step, sheet formation can be kept undisturbed, so that a hydroentangled nonwoven fabric having a superb sheet formation, unique to the present invention, is obtained.

Market places for such uniquely good formation nonwoven fabric may be medical and sanitary for instance. Having excellent drape, softness in particular due to use of fine fibers (i.e. less than 7 μm in diameter), and barrier, the fabric is favorably applied for surgical masks, gowns, bandages and the like. Having excellent air permeability despite use of such fine fibers and being able to provide liquid barrier by a water repellency treatment, the fabric is also favored for substrates of liquid and gas filters. Furthermore, having excellent texture, formation and uniformity, the fabric is favored for substrate of artificial leathers or high grade suede-like leathers in particular. These are just a few examples and applications of the fabric are not limited thereto.

The nonwoven fabric of the present invention is a novel fabric made of fibers having the specific diameter and L/D ratio and exhibits excellent sheet formation, drape, pleasing touch and texture, softness, high air permeability, and high strength properties all together. These favorable characteristics are conflicting each other, therefore are hardly accommodated by any single class of conventional nonwovens.

The nonwoven fabric of the second aspect of the present invention comprises 10–90% by weight based on the nonwoven fabric of fibers, of which diameter is 7 μm or less and of which L/D ratio is no greater than 2000, and 90–10% by weight based on the nonwoven fabrics of fibers, of which diameter is 7 μm or less and of which L/D ratio in the range of $2000<L/D<6000$, the maximum pore size being 5 times or less the mean pore size and the fibers three-dimensionally entangled. The nonwoven fabric may contain thermalbonding fibers as binder.

As noted in the foregoing paragraph, two classes of fibers are used in the nonwoven fabric of the second aspect of the present invention; one having diameter of 7 μm or less and L/D ratio of 2000 or less (hereinafter referred to as "low L/D fiber"), and the other having diameter of 7 μm or less and L/D ratio in the range of $2000<L/D\leqq 6000$ (hereinafter referred to as "high L/D fiber"). As fibers of both of said classes, organic fibers used in the first aspect as described earlier are preferred. When diameter of the fibers exceeds 7 μm, the resulting nonwoven fabric exhibits poor touch and drape. The diameter of fibers of both of said two classes is preferably within a range of 1–5 μm in view of further improving touch. The materials of the low L/D and high L/D fibers may be the same or different.

Amount of the high L/D fibers in the fiber furnish is preferably 10–90% by weight. When it is less than 10%, the three-dimensional entanglement fails to take place effectively so that strength characteristics of the resulting nonwoven goes down; when it is more than 90%, uniform dispersion of fiber furnish prior to being laid becomes hard unless fiber concentration of the furnish is lowered substantially thereby lowering productivity. In addition, vacuum has to be raised on a former in order to assist drainage and to maintain productivity, thereby requiring greater amount of energy.

A small amount of fibers other than said two classes of fibers, having different shape, diameter and L/D ratio going out of said ranges, may be added to the fiber furnish unless such addition adversely affect performances of the nonwoven fabric of the present invention.

Said maximum and mean pore size of the nonwoven fabric can be determined according to ASTM F-316, "Standard Test Methods for Pore Size Characteristics of Membrane Filters by Bubble Point and Mean Pore Test". The maximum pore size of the nonwoven fabric of the present invention is preferably 250 μm or less, and the mean pore size preferably 150 μm or less. When the maximum pore size and mean pore size is larger than 250 μm and 150 μm respectively, the fabric reflects less effective three-dimensional entanglement so that its strength characteristics is poor. It is thought that the smaller the pore size, the more intensive entanglement has taken place.

In order to assure uniform fiber entanglement, the maximum pore size must be 5 times or less the mean pore size. If the maximum pore size is greater than 5 times the mean pore size, the fabric reflects poor sheet formation and uniformity, and further insufficient fiber entanglement, poor drape and touch. By monitoring the maximum and mean pore size, not only degree of fiber entanglement, sheet formation and uniformity, but also touch and drape attributable thereto can be assured.

The nonwoven fabric of the second aspect of the present invention not employing the thermalbonding fibers may be produced by the following steps.

A fiber furnish comprising 10–90% by weight of said high L/D fibers and 90–10% by weight of said low L/D fibers is prepared and is formed on a wet-laid former into a web, one or more of which web stacked on a supporting mesh cloth and subjected to high pressure water jets to let fibers in the stacked webs entangle three-dimensionally. The fiber integrity thus obtained, i.e. nonwoven fabric, is then drained and dried.

In disintegrating and dispersing the high L/D fibers, care must be taken to avoid entwisting of fibers, otherwise entwisted fiber bundles or strings degrade sheet formation of the precursor web thereby influences harmfully on performance of the resulting nonwoven fabric. While a rotaing impeller type unit may be used in the disintegration and dispersion of the fiber furnish, a reciprocating type unit is more preferable in view of retaining dispersion of the furnish uniformly after disintegration. Addition of a dispersing agent to water prior to disintegration, or soaking of (staple) fibers in a solution containing 1% by weight of a dispersing agent, is recommended in order to promote disintegration and to prevent entwisting of fibers after disintegration.

While order of addition of the both classes of fibers is not specifically limited, the low L/D fibers which can be dispersed more easily are preferably added first and dispersed, followed by addition and dispersion of the high L/D fibers. This order of addition helps preventing formation of fiber bundles and strings. It is thought that the low L/D fibers added and dispersed first function a kind of buffer, i.e. they trespass into the high L/D regions and help maintain fiber-to-fiber distance. It is an effect not expected that use of the low L/D fibers helps not only increase fiber consistency of the fiber slurry but also helps prevent formation of fiber bundles and strings.

Agitation of the fiber slurry for disintegration of (staple) fibers is preferably carried out quickly. If the disintegration is not through after a short run of agitation, agitation rate is raised with a jerk in order to give a shock to unseparated mass of fibers and to promote disintegration. Such raise in agitation rate should not last longer than a few seconds, otherwise fibers tend to become entwisted forming bundles and strings. If there remain unseparated mass after jerking up of rate once, that action may be repeated twice or more.

Dispersion takes place in continuation to disintegration, wherein the fiber slurry is kept under a moderate agitation to Prevent coagulation, is diluted with water, and added quickly with a viscosity modifier. Throughout this step, agitation rate should be maintained as moderate as possible. Uniformly dispersed fiber slurry is thus prepared, where the term uniform means the fiber slurry being kept under a moderate agitation in which substantially no bundles or strings of fibers are observable.

As described earlier, fiber concentration of the fiber slurry can be increased by use of both high and low L/D fibers in combination, thereby basis weight of web formed of it as well as web forming efficiency can be increased. The thus prepared fiber slurry is wet-laid on a former to make a web, which in turn may be processed by water jets for three-dimensional fiber entanglement.

The fiber entanglement process may be placed right after the wet-laid former in the case of an on-machine production line, or it may be separate in the case of an off-machine production line. The on-machine system is preferable in that process is simplified and a step for rewetting the web can be omitted since it is already wet. The on-machine system is effective when a relatively light weight or a relatively easy-to-entangle precusor web is produced. In the case of off-machine system, addition of binder to fiber furnish is required since the web formed is dried and must be a fiber integrity for being handled.

The binder may be water-soluble one, hot water-soluble one, or ones having fibrous structure, of which material may be polyvinyl alcohol, modified polyester, polyolefin, or other polymers. It may be added in a form of solution, or aqueous dispersion (if it is fibrous one), to the fiber slurry prior to web formation; or, its solution may be applied by dip coating to a web formed. Both of these may be done in combination.

Amount of the binder is preferably 1–10% by weight based on the web formed on a wet-laid former. If the amount is less than 1%, strength of the web formed is too low to be handled and processed in later steps; if it exceeds 10%, inter-fiber bond develops so intense that very high hydraulic pressure is required for hydraulic entanglement and that inter-layer bond after hydroentanglement is weak.

The precursor web formed on a wet-laid former may be dried by an ordinary means using a Yankee dryer, multi-cylinder dryer, through air dryer or the like. Since fibers in the precursor web are fixed by a binder, its sheet formation becomes destructed little when it is subjected to high pressure water jets for entanglement; described alternately, the web obtained under the aspect of the present invention withstands relatively higher energy water jets. A desired number or the precursor sheet may be stacked and subjected to hydroentanglement to make a relatively heavy weight nonwoven fabric, wherein higher energy water jets have to be applied so that use of the web having that withstandability is favored.

Since the binder component is soluble to water or hot water, it can be washed off in the course of hydroentanglment. In order to remove the component entirely, a stack of precursor sheets may be saturated with water or hot water prior to or post to the hydroentanglement process.

As explained heretofore, a production system (i.e. on-machine, off-machine, and combination of both) should be selected depending on kind of fiber material and basis weight.

Referring to said hydroentanglement step in more detail, a stack of the precursor sheet(s) is put on a 50–200 mesh wire-cloth and is allowed under high pressure water jets for achieving three-dimensional fiber entanglement. Some of the process parameters to assure sufficient and optimum fiber entanglement are described in the following.

In order to create fine, high-velocity, columnar streams of water, effecting desired entanglement while maintaining good sheet formation, diameter of small holes creating the streams is preferably 10–500 μm and hole-to-hole distance is preferably 10–1500 μm.

A jet header in which a number of small holes are driven is set perpendicular to the direction of fabric travel and should cover throughout width of fabric being processed. Number of the jet headers to be placed in series along machine direction to attain sufficient entanglement may be variable depending on kind of a fabric to be processed, its basis weight, processing speed, and water pressure. This hydroentanglement process can be repeated as desired.

Water pressure is preferably 10–250 $Kg/cm^2$, more preferably 50–250 $Kg/cm^2$, and processing speed 5–200 m/min. When the pressure is low, sufficient entanglement can not be attained; when the pressure is excessively high, sheet formation or uniformity of the fabric may suffer damage, or the fabric destroyed. Water pressure can be raised stepwise from the first to the last jet header, so that intensive entanglement is effected without degrading surface integrity of the fabric. Diameter or population of holes can be decreased stepwise from the first to the last jet header to improve surface quality of the fabric. Furthermore, a jet header can be rotated or oscillated, or a wire cloth conveying the fabric is oscillated to further improve the surface quality. Still another method to polish surface integrity is to insert a 40–100 mesh wirecloth between an already entangled fabric and a jet header in order to mute water streams or spray onto the fabric.

A fabric can be hydroentangled on only one side, or on both sides. A fabric once entangled can be stacked with another sheet(s) and can be hydroentangled again.

The hydroentangled and three-dimensionally fiber entangled fabric thus prepared is squeezed by vacuuming or pressing to remove water, and dried by an air dryer, a through air dryer, a suction through dryer, or the like.

It goes without saying that a dry-laid nonwoven, pulp sheet, or a wet laid sheet comprising fibers other than those specified earlier can be stacked on a side, both sides or inbetween, and can be hydroentagled on a side or both. Needless to say, such variation is authorized only to an extent that the purposes of the present invention are fulfilled.

The thus obtained hydroentangled nonwoven fabric according to the present invention may further receive some other physical or chemical treatment like folding, stretching, craping, resin impregnation, water wetting or repelling treatment, and the like, to provide a variety of special functions.

Market places for the nonwoven fabric having excellent sheet formation may be medical and sanitary for instance. Having excellent drape, softness in particular due to use of fine fibers (i.e. less than 7 μm in diameter), and barrier, the fabric is favorably applied for surgical masks, gowns, bandages and the like. Having excellent air permeability despite use of such fine fibers and being able to provide liquid barrier by a water repellency treatment, the fabric is also favored for substrates of liquid and gas filters Furthermore, having excellent texture, formation and uniformity, the fabric is favored for substrate of artificial leathers or high grade suede-like leathers in particular. These are just a few examples and applications of the fabric are not limited thereto.

The nonwoven fabric under the aspect of the present invention comprises very fine and three dimensionally entangled fibers has specific size pores, and has excellent sheet formation and uniformity, so that it exhibits pleasing touch and texture, drape, high air permeability, and high strength properties which have not hitherto been attained by any conventional nonwovens.

In addition, by use of said high and low L/D fibers in combination, dispersibility of the fibers is improved and as a result a nonwoven fabric having said favourable characteristics has come to be obtained at a high efficiency.

The nonwoven fabric of the second aspect of the present invention contains 1–20% by weight of thermal bonding fibers based on weight of the nonwoven fabric The thermalbonding fibers may be ones those employed in the first aspect of the present invention. The nonwoven under the aspect may be produced by the following steps.

A web is formed on a wet-laid former of a fiber furnish comprising 10–90% by weight of said high L/D fibers, 90–10% by weight of said low L/D fibers, and 1–10% by weight of the thermalbonding fibers, and dried. By virtue of heat applied in the drying step, low melting point component of the thermalbonding fibers fuses to bind fibers at intersecting points. One or more layers of the web thus formed are stacked and high pressure water jets are applied on the pile and fibers in the pile are allowed to entangle three-dimensionally. The fiber sheet thus entangled is drained.

The production process is similar to that for producing the nonwoven fabric not containing thermalbonding fibers of the second aspect of the present invention as described earlier except that thermalbonding fibers are used, thereby requiring certain specific conditions. Some explanations should be made as follows in complement.

Sum of the high and low L/D fibers constitutes 80–99% by weight of the fiber furnish, the thermalbonding fiber the rest, i.e. 20–1% by weight, and the high L/D fibers should be 10–90% by weigh of the sum. If the sum of the high and low L/D fibers exceeds 99% by weight, the precursor web prior to entanglement is too weak to be handled; if it is less than 80% by weight, inter-fibers bond is too intense to obtain a fabric having favorable drape and touch characteristics that the present invention aims at. If amount of the high L/D fibers exceeds 90% by weight of the sum, fiber bundles and strings are easily formed during disintegration and dispersion steps unless fiber concentration is lowered thereby lowering productivity., if it is less than 10% by weight, strength properties of the nonwoven fabric after three-dimensional entanglement become poor.

In disintegrating and dispersing the high L/D fibers, care must be taken to avoid entwisting of fibers. As mentioned earlier, entwisted fiber bundles and strings degrade sheet formation of the precursor web thereby influences significantly on performance of the resulting nonwoven fabric.

If the thermalbonding fibers employed as binder fibers have diameter and L/D ratio that fall within same of the high L/D fibers, they are preferably disintegrated and dispersed with the high L/D fibers together and simultaneously; if L/D ratio of the binder fibers is low, then they are preferably disintegrated and dispersed with the low L/D fibers together.

One or more of the precursor sheets prepared are stacked, placed on a 50–200 mesh wirecloth, and subjected to high pressure water jets to let fibers in the stack entangled three-dimensionally. Fibers in the precursor web is bound by the thermalbonding fibers, but there are a lot of cut ends or portions of fibers not bound at intersecting points. When the hydroentanglement takes place, such ends or portions of fibers become entangled, and in addition a lot of fibers are released by energy of the high pressure water jets from binding intersectional points, and are entangled three dimensionally together. Sheet formation is destructed little during the hydraulic entanglement step due assumedly to that fibers released from bond are entangled instantly, so that a hydroentangled nonwoven fabric having a superb formation, unique to the present invention, is obtained.

The hydroentanglement may be carried out in the same way as that described earlier for a nonwoven fabric under the aspect not containing thermalbonding fibers.

Special mentions should be made here, however, about drying temperature applied to the fabric after hydroentanglement. When a fabric very soft and rich in drape is desired, the hydroentangled fabric is preferably dried under a temperature lower than melting point of the thermalbonding fiber component. In obtaining a fabric having high strength properties, the drying temperature is preferably higher than melting point of the thermal bonding fiber component. When strength properties of the fabric have to be further emphasized, a drying system which effects compression of the fabric along its Z-direction may be employed; compression and heat applied in combination promote contact between the main furnish fibers having diameter less than 7 μm and the thermalbonding fibers, thereby strength of the fabric may be further amplified. The resulting web, however, is poor in drape, so that such web, while the stiffening effect may be muted to certain extent by selecting shorter thermalbonding fibers, is not suitable for an application where drape characteristics is mandatory. Setting aside of the softness or drape requirements, use of the thermalbonding fibers in drying step helps make handling of precursor webs easier thereby contributes to high productivity.

The present invention is explained in detail referring to the following examples, but is not intended to be limited thereto.

In the following examples, parts and % are by weight unless otherwise specified, and diameter and length of fibers refer to mean value. Stiffness was determined by a 45 degree cantilever method in accordance with JIS-L1096 and the value refers to average of ones along MD (machine direction) and CD (crossmachine direction). The air permeability was determined according to JIS-L1096 Format I and refers to a pressure loss at an air velocity of 5.3 cm/sec.

Sheet formation of the fabric or precursor web was determined by eye-observation and each of the grading signs means the following;

◎: excellent
○: good
Δ: poor
X: bad

Maximum and mean pore size of the fabric was determined in accordance with the "Bubble Point Method" and "Mean Flow Point Method" as described in ASTM F-316. Filtering efficienty was also measured at air velocity of 5.3 cm/sec using 0.3 um DOP (dioctylphthalate) aerosol as model particulate by measuring particle counts at upper and down streams of the fabric. The filtering efficienty is thought to represent barrier performance of a nonwoven fabric.

EXAMPLE 1

97 parts of a polyethylene terephthalate (PET) fiber (fiber diameter=3 μm, L/D=2300) having finess of 0.1 denier and length of 7 mm and 3 parts of a hot water-soluble polyvinyl alcohol fiber (VPB 103 manufactured by Kuraray Co.) having a fineness of 1 denier and length of 3 mm were soaked in a 1% aqueous solution of a nonionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried. A polyethylene terephthalate precursor web having a width of 50 cm and basis weight 20 g/m$^2$ was obtained. Four sheets of the thus obtained web was stacked on a 100 mesh stainless steel wirecloth and subjected to a hydroentanglement processor having 3 water jets headers in series. The primary header had 2 rows of holes of which diameter was 120 μm and hole-to-hole distance was 1.2 mm and water pressure was maintained at 120 kgf/cm$^2$; the secondary header had a single row holes of which diameter 120 μm, hole-to-hole distance 0.6 mm, and water pressure at 100 kgf/cm$^2$; the tertiary header had a single row holes of which diameter 100 μm, hole-to-hole distance 0.6 mm, and water pressure at 120 kgf/cm$^2$. By letting the web stack with the wirecloth together under these headers, fibers were allowed to entangle while the binder was washed off. The fabric was then turned over, placed on the same wirecloth and hydroentangled similarly on the other side. Processing rate was kept 20 m/min both ways. The thus processed fabric was drained and dried using a suction through drier at 130° C. to make a hydroentangled nonwoven fabric having excellent sheet formation.

EXAMPLE 2

The procedure of Example 1 was repeated except that the PET fiber length was 10 mm (and L/D=3300) to obtain a hadroentangled nonwoven having excellent sheet formation and fulfilling the aim of the present invention. Maximum and mean pore size of the fabric was determined to be 40.6 μm and 15.5 μm respectively, and

EXAMPLE 3

The procedure of Example 1 was repeated except that the PET fiber length is 15 mm (and L/D=5000), and a hydroentangled nonwoven fabric having excellent sheet formation was obtained.

COMPARATIVE EXAMPLE 1

The procedure of Example 1 was repeated except that the PET fiber length was 3 mm (and L/D=1000), and a hydroentangled nonwoven fabric was obtained. The resulting nonwoven fabric showed poor strength characteristics since the PET fiber had low L/D ratio therefore is not long enough to be entangled sufficiently. In addition, surface integrity of the fabric as well as sheet formation were somewhat disturbed by the water jets.

COMPARATIVE EXAMPLE 2

The procedure of Example 1 was repeated except that the PET fiber length was 20 mm (and L/D=6700), and a hydroentangled nonwoven fabric was obtained. The precursor sheet was poor in sheet formation and contained a lot of unseparated mass and fiber bundles or strings reflecting difficulty in disintegrating and dispersion of such long fiber. The poor sheet formation resulted in insufficient fiber entanglement, therefore resulted in poor strength properties, inferior sheet formation, and unsatisfactory surface aesthtics of the fabric.

EXAMPLE 4

The procedure of Example 2 was repeated to prepare a wet-laid precursor sheet. Hydroentanglement procedure of Example 1 was repeated except that only a single layer of that precursor sheet was used, that water pressure of the primary, secondary and tertiary jet headers was regulated to 50, 50 and 70 kgf/cm$^2$ respectively, and that hydroentanglement was done on only one side. As a result, a spunlace nowoven fabric having excellent sheet formation was obtained.

EXAMPLE 5

The nonwoven fabric of Example 2 after hydroentanglement was put through 60° C. water to extract binder components contained therein, then was drained and dried exactly as Example 2. As a result, a hydroentangled nonwoven fabric having excellent sheet formation and fulfilling the purpose of the present invention was obtained.

COMPARATIVE EXAMPLE 3

The procedure of Example 1 was repeated except that the PET fiber having fineness of 1 denier (diameter=10 μm) and length of 51 mm (therefore L/D=5100) was used, and a hydroentangled nonwoven fabric was obtained. The precursor sheet was poor in sheet formation and contained a lot of unseparated mass and fiber bundles or strings reflecting difficulty in disintegrating and dispersion of such long fiber. The poor sheet formation resulted in insufficient fiber entanglement, therefore resulted in poor strength properties, inferior sheet formation, and unsatisfactory surface aesthtics of the fabric.

EXAMPLE 6

97 parts of a polyacrylonitrile (PAN) fiber (fiber diameter=3.5 μm, L/D=2800) having fineness of 0.1 denier and length of 10 mm and 3 parts of a hot water-soluble polyvinyl alcohol fiber (VPB 103 manufactured by Kuraray Co.) having fineness of 1 denier and length of 3 mm were soaked in a 1% aqueous solution of an anionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried. A polyacrylonitlile precursor web having a width of 50 cm and basis weight 20 g/m$^2$ was obtained. Hydroentanglement procedure was repeated exactly as Example 1, and the thus processed fabric was drained and dried using a suction through drier at 100° C. to make a hydroentangled nonwoven fabric having excellent sheet formation. The maximum and mean pore size of the fabric was 49.1 μm and 19.1 μm respectively.

EXAMPLE 7

97 parts of a polypropylene (PP) fiber (fiber diameter=4 μm, L/D=2500) having fineness of 0.1 denier and length of 10 mm and 3 parts of a hot water-soluble polyvinyl alcohol fiber (VPB 103 manufactured by Kuraray Co.) having fineness of 1 denier and length of 3 mm were soaked in a 1% aqueous solution of a anionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried. A polypropylene precursor web having a width of 50 cm and basis weight 20 g/m$^2$ was obtained. Hydroentanglement procedure was repeated exactly as Example 1 except that water pressure of the primary, secondary and tertiary jet headers was regulated to 120, 140 and 150 kgf/cm$^2$ respectively, and the thus processed fabric was drained and dried using a suction through drier at 100° C. to make a hydroentangled nonwoven fabric having excellent sheet formation. The maximum and mean pore size of the fabric was 49.2 μm and 21.9 μm respectively.

COMPARATIVE EXAMPLE 4

90 parts of the polyethylene terephthalate fiber used in Example 1 and 10 parts of a sheath-core type polyester thermalbonding fiber (Melty 4080 manufactured by Unitika Co., melting point of the sheath being 110° C.) having fineness of 2 denier and length of 5 mm were processed into fiber slurry and formed into a wet-laid web following the procedure of Example 1. The web was dried by a cylinder drier at 110° C. and basis weight of it was 80 g/m$^2$. Thus, a nonwoven fabric was obtained. While diameter and L/D of the main furnish fiber fall within the criteria specified in the present invention, the fabric obtained was stiff and poor in texture and drape since it was only laid and not hydroentangled. Despite use of the sheath-core type binder fiber having relatively large diameter and of which surface (sheath) consists entirely of a heat-fusible component, air permeability was lower than the hydroentangled nonwoven fabric of the present invention.

Table 1 summarizes performance date of Examples 1–7 and Comparative Examples 1–4.

TABLE 1

| | Basis Wt. g/m$^2$ | Caliper μm | Tensile kg/15 mm MD | Tensile kg/15 mm CD | Stiffness mm | Pressure loss mmAq. | Sheet Formation |
|---|---|---|---|---|---|---|---|
| Example | | | | | | | |
| 1 | 75.9 | 384 | 4.2 | 3.0 | 51 | 4.8 | ◎ |
| 2 | 77.8 | 350 | 5.5 | 3.9 | 60 | 4.6 | ◎ |
| 3 | 80.0 | 351 | 6.7 | 4.7 | 63 | 4.8 | ◎ |
| 4 | 19.8 | 89 | 1.3 | 1.0 | 18 | 1.1 | ◎ |
| 5 | 77.6 | 351 | 5.4 | 4.1 | 51 | 4.4 | ◎ |
| 6 | 78.2 | 360 | 5.3 | 4.4 | 69 | 4.3 | ◎ |
| 7 | 76.9 | 365 | 5.8 | 4.7 | 68 | 3.9 | ◎ |
| Comparative Example | | | | | | | |

TABLE 1-continued

| | Basis Wt. g/m$^2$ | Caliper μm | Tensile kg/15 mm MD | Tensile kg/15 mm CD | Stiffness mm | Pressure loss mmAq. | Sheet Formation |
|---|---|---|---|---|---|---|---|
| 1 | 76.1 | 359 | 1.1 | 0.8 | 65 | 5.5 | Δ |
| 2 | 77.3 | 340 | 4.0 | 2.1 | 80 | 4.3 | X |
| 3 | 78.1 | 635 | 1.9 | 1.4 | 102 | 0.6 | X |
| 4 | 81.1 | 257 | 2.6 | 1.9 | 150 UP | 13.1 | Δ |

EXAMPLE 8

95 parts of a polyethylene terephthalate fiber (fiber diameter=3 μm, L/D=2300) having fineness of 0.1 denier and length of 7 mm and 5 parts of a sheath-core type polyester thermalbonding fiber (Melty 4080 manufactured by Unitika Co., melting point of the sheath being 110° C.) having fineness of 2 denier and length of 5 mm were soaked in a 1% aqueous solution of a nonionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried at 110° C. A polyethylene terephthalate precursor web having a width of 50 cm and basis weight 20 g/m$^2$ was obtained. Four sheets of the thus obtained web was stacked on a 100 mesh stainless steel wirecloth and subjected to a hydroentanglement processor having 3 water jets headers in series. The primary header had 2 rows of holes of which diameter was 120 μm and hole-to-hole distance was 1.2 mm and water pressure was maintained at 100 kgf/cm$^2$; the secondary header had a single row holes of which diameter 120 μm, hole-to-hole distance 0.6 mm, and water pressure at 100 kgf/cm$^2$; the tertiary header had a single row holes of which diameter 100 μm, hole-to-hole distance 0.6 mm, and water pressure at 120 kgf/cm$^2$. By letting the web stack with the wirecloth together under these headers, fibers were allowed to entangle and at the same time the main furnish fibers being released from bond with the binder fibers were allowed to entangle three-dimensionally. The fabric was then turned over, placed on the same wirecloth and hydroentangled similarly on the other side. Processing rate was kept 20 m/min both ways. The thus processed fabric was drained and dried using a suction through drier at 130° C. to make a hydroentangled nonwoven fabric having excellent sheet formation.

EXAMPLE 9

The procedure of Example 8 was repeated except that the PET fiber length was 10 mm (and L/D=3300), and a hydroentangled nonwoven fabric having excellent sheet formation and fulfilling the aim of the present invention was obtained. Maximum and mean pore size of the fabric determined exactly as Example 2 was 42.6 μm and 16.4 μm respectively, and filtering efficienty of the fabric determined likewise was 28.4%.

EXAMPLE 10

The procedure of Example 8 was repeated except that the PET fiber length was 15 mm (and L/D=5000), and a hydroentangled nonwoven fabric having excellent sheet formation and fulfilling the aim of the present invention was obtained.

COMPARATIVE EXAMPLE 5

The procedure of Example 8 was repeated except that the PET fiber length was 3 mm (and L/D=1000). The precursor sheet was poor in strength characteristics since L/D ratio of the PET fiber is low reflecting short length and was hydroentangled insufficiently. In addition there was observed certain turbulence in surface integrity and sheet formation caused by water jets.

COMPARATIVE EXAMPLE 6

The procedure of Example 8 was repeated except that the PET fiber length was 20 mm (and L/D=6700), and a hydroentangled nonwoven fabric was obtained. The precursor sheet was poor in sheet formation and contained a lot of unseparated mass and fiber bundles or strings reflecting difficulty in disintegrating and dispersing of such long fiber. The poor sheet formation resulted in insufficient fiber entanglement, therefore resulted in poor strength properties, inferior sheet formation, and unsatisfactory surface aesthtics of the fabric.

Using the fibers of Example 9, a precursor web was obtained by carrying out the procedure of Example 8. This web was hydroentangled exactly as Example 8 except that only a single layer of that precursor sheet was used, that water pressure of the primary, secondary and tertiary jet headers was regulated to 50, 50 and 70 kgf/cm$^2$ respectively, and that hydroentanglement was done on only one side. As a result, a hydroentangled nowoven fabric having excellent sheet formation was obtained.

EXAMPLE 12

The procedure of Example 9 was repeated except that 9 parts of a polyolefin sheath-core type thermalbonding fiber (ES Fibre, manufactured by Chisso Co.) having fineness of 1.5 denier and length of 5 mm and 91 parts of the main furnish fibers were used, and a hydroentangled nonwoven fabric having excellent sheet formation and fulfilling the aim of the present invention was obtained.

EXAMPLE 13

The procedure of Example 9 was repeated except that 8 parts of a polyolefin sheath-core type thermalbonding fiber (UBF Fiber, manufactured by Daiwabo Co.), of which fineness is 2 denier and length 6 mm and of which sheath becomes sticky when moistened and heated, and 91 parts of the main furnish fibers were used, and that prior to hydroentanglement the stack of the precursor sheets were dipped in 90° C water to extract said sheath binder component. A hydroentangled nonwoven fabric having excellent sheet formation and fulfilling the aim of the present invention was obtained.

COMPARATIVE EXAMPLE 7

The procedure of Example 8 was repeated except that the PET fiber having fineness of 1 denier (diameter=10 μm) and length of 51 mm (therefore L/D=5100) was used, and a hydroentangled nonwoven fabric was obtained. The precursor sheet was poor in sheet formation and contained a lot of unseparated mass and fiber bundles or strings reflecting difficulty in disintegrating and dispersion of such long fiber. The poor sheet formation resulted in insufficient fiber entanglement, therefore resulted in a fabric inferior sheet formation, and poor in touch, texture and drape.

EXAMPLE 14

95 parts of a polyacrylonitrile (PAN) fiber (fiber diameter=3.5 μm, L/D=2800) having fineness of 0.1 denier and length of 10 mm and 5 parts of a sheath-core type polyester thermalbonding fiber (Melty 4080 manufactured by Unitika Co., melting point of the sheath being 110° C.) having fineness of 2 denier and length of 5 mm were soaked in a 1% aqueous solution of an anionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried. A polyacrylonitrile precursor web having a width of 50 cm and basis weight 20 g/m$^2$ was obtained, which in turn was hydroentangled exactly as Example 8. The thus processed fabric was drained and dried using a suction through drier at 100° C. to make a hydroentangled nonwoven fabric having excellent sheet formation. The maximum and mean pore size of the fabric was 49.0 μm and 19.3 μm respectively.

EXAMPLE 15

95 Parts of a polypropylene (PP) fiber (fiber diameter=4 μm, L/D=2500) having fineness of 0.1 denier and length of 10 mm and 5 parts of a sheath-core type polyester thermalbonding fiber (Melty 4080 manufactured by Unitika Co., melting point of the sheath being 110° C.) having of 5 mm were soaked in a 1% aqueous solution of an nonionic dispersing agent. The preparation was put into water and moderately stirred using a reciprocating type impeller (Agitor, manufactured by Shimazaki Seisakusho Ltd.) for disintegration, then added quickly with a 0.1% aqueous solution of a viscosity modifier (polyacrylamide solution) and was allowed to stand under a moderate stirring to make a fiber slurry in which fibers were uniformly dispersed. The fiber slurry was laid on a Fourdrinier former and dried. A polypropylene precursor web having a width of 50 cm and basis weight 20 g/m$^2$ was obtained, which in turn was hydroentangled exactly as Example 8 except that water pressure of the primary, secondary and tertiary jet headers was regulated to 120, 140 and 150 kgf/cm$^2$ respectively. The thus processed fabric was drained and dried using a suction through drier at 100° C. to make a hydroentangled nonwoven fabric having excellent sheet formation and fulfilling the aim of the present invention was obtained. The maximum and mean pore size of the fabric was 49.2 μm and 21.9 μm respectively.

COMPARATIVE EXAMPLE 8

90 parts of the PET fiber and 10 parts of the thermalbonding fiber were processed exactly as Example 8 to make a web having basis weight of 80 g/m$^2$. The web was dried by a cylinder drier at 110° C. and thus, a nonwoven fabric was obtained. While diameter and L/D of the main furnish fiber fall within the criteria specified in the present invention, the fabric obtained was dense and poor in texture and drape since it was only laid and not hydroentangled. Despite use of the sheath-core type binder fiber having relatively large diameter and of which surface (sheath) consists entirely of a heat-fusible component, air permeability was lower than the hydroentangled nonwoven fabric of the present invention.

Table 2 summarizes performance data of Examples 8–15 and Comparative Examples 5–8.

TABLE 2

| | Basis Wt. g/m² | Density g/cm³ | Tensile kg/15 mm MD | Tensile kg/15 mm CD | Stiffness mm | Pressure loss mmAq. | Sheet Formation |
|---|---|---|---|---|---|---|---|
| Example | | | | | | | |
| 8 | 80.5 | 0.195 | 4.2 | 3.0 | 51 | 4.8 | ◎ |
| 9 | 81.3 | 0.220 | 5.5 | 3.9 | 60 | 4.5 | ◎ |
| 10 | 80.5 | 0.227 | 6.7 | 4.7 | 63 | 4.6 | ◎ |
| 11 | 19.9 | 0.222 | 1.3 | 1.0 | 18 | 1.0 | ◎ |
| 12 | 80.7 | 0.221 | 5.4 | 4.1 | 51 | 4.4 | ◎ |
| 13 | 79.6 | 0.208 | 5.0 | 4.0 | 50 | 4.0 | ◎ |
| 14 | 80.7 | 0.215 | 5.3 | 4.4 | 64 | 4.2 | ◎ |
| 15 | 80.2 | 0.205 | 5.8 | 4.7 | 63 | 3.7 | ○ |
| Comparative Example | | | | | | | |
| 5 | 76.1 | 0.212 | 1.1 | 0.8 | 65 | 5.4 | Δ |
| 6 | 77.3 | 0.227 | 5.0 | 3.2 | 80 | 4.1 | X |
| 7 | 80.1 | 0.123 | 1.9 | 1.4 | 102 | 0.6 | X |
| 8 | 81.1 | 0.316 | 2.6 | 1.9 | 150 up | 13.1 | Δ |

Touch or handle characteristics of webs or fabrics appearing in the following Examples 16–21 and Comparative Examples 10–12 were evaluated by sense and each of the grading signs means the following;

◎: excellent
○: good
Δ: poor
X: bad

Unless otherwise specified, "web" means a precursor web or sheet formed on a wet-laid former and "fabric" a three-dimensionally hydroentangled fiber integrity.

EXAMPLES 16–18 AND COMPARATIVE EXAMPLE 9

Main fiber furnish consisted of a polyethylene terephthalate (PET) fiber, of which fineness is 0.1 denier, length 10 mm, diameter 3 um, and L/D ratio 3300 as high L/D fiber, and an another PET fiber, of which fineness is 0.1 denier, length 5 mm, and L/D ratio 1700. Ratio of the high and low L/D fiber amount was varied as shown in Table 3. 3 parts of a hot water-soluble polyvinyl alcohol fiber (VPB 103 manufactured by Kuraray CO.) was mixed as a binder fiber with 100 parts of sum of the high and low L/D fibers.

The binder fiber and the low L/D fiber was disintegrated first in a pulper under relatively high rate agitation. The fiber slurry prepared was diluted with water, then transferred into a chest equipped with a reciprocating type impeller (Agitor, stirring, a fiber preparation in which the high L/D fiber had been soaked in a 1% aqueous solution of a nonionic dispersing agent was added to the chest. Stirring rate was raised with a jerk for a few seconds and brought back moderate, and this procedure was repeated 3 times to disintegrate fibers thoroughly. Then, an aqueous solution of 1% polyacrylamide was added quickly to the fiber slurry, stirring rate was raised again and brought down, and this procedure was repeated 3 times to complete dispersion. The fiber slurry was laid on a Fourdrinier former

TABLE 3

| | Fiber Furnish: High L/D Fiber parts in 100 parts | Fiber Furnish: Low L/D Fiber parts in 100 parts | Nbr. of precursor sheets plied |
|---|---|---|---|
| Example | | | |
| 16 | 3 μmΦ × 10 mmL PET 70 | 3 μmΦ × 5 mmL PET 30 | 20.5 g/m² × 4 |
| 17 | 3 μmΦ × 10 mmL PET 50 | 3 μmΦ × 5 mmL PET 50 | 20.5 g/m² × 4 |
| 18 | 3 μmΦ × 10 mmL PET 30 | 3 μmΦ × 5 mmL PET 70 | 20.5 g/m² × 4 |
| Comparative Example | | | |
| 9 | 3 μmΦ × 10 mmL PET 5 | 3 μmΦ × 5 mmL PET 95 | 20.5 g/m² × 4 |

and dried using a Yankee drier at 110° C. A PET precursor web having a width of 50 cm and basis weight 20.5 g/m2 was obtained for each of Examples 16–18 and Comparative Example 9.

TABLE 4

| | Fiber Furnish: High L/D Fiber parts in 100 parts | Fiber Furnish: Low L/D Fiber parts in 100 parts | Nbr. of precursor sheets plied |
|---|---|---|---|
| Example | | | |
| 19 | 3 μmΦ × 7 mmL PET 85 | 3 μmΦ × 5 mmL PET 15 | 20.5 g/m² × 4 |
| 20 | 3 μmΦ × 15 mmL PET 20 | 3 μmΦ × 3 mmL PET 80 | 20.5 g/m² × 4 |
| 21 | 5 μmΦ × 15 mmL PET 30 | 3 μmΦ × 5 mmL PET 70 | 20.5 g/m² × 4 |
| Comparative Example | | | |
| 10 | 3 μmΦ × 20 mmL PET 20 | 3 μmΦ × 3 mmL PET 80 | 20.5 g/m² × 4 |
| 11 | 3 μmΦ × 10 mmL PET 50 | 3 μmΦ × 5 mmL PET 50 | 20.5 g/m² × 4 |

Four sheets of the thus obtained web for each of Examples 16–18 and Comparative Example 9 were stacked on a 100 mesh stainless steel wirecloth and subjected to a hydroentanglement processor having 3 water jets headers in series. The primary header had 2 rows of holes of which diameter was 120 μm and hole-to-hole distance was 1.2 mm and water pressure was maintained at 100 kgf/cm$^2$; the secondary header had a single row holes of which diameter 120 μm, hole-to-hole distance 0.6 mm, and water pressure at 100 kgf/cm$^2$; the tertiary header had a single row holes of which diameter 100 μm, hole-to-hole distance 0.6 mm, and water pressure at 120 kgf/cm$^2$. By letting the web stack with the wirecloth together under these headers, fibers were allowed to entangle. The fabric was then turned over, placed on the same wirecloth and hydroentangled similarly on the other side. Processing rate was kept 20 m/min both ways. The thus processed fabric was drained and dried using a suction through drier at 120° C. to make a hydroentangled nonwoven fabric. Characteristics data for each of Examples 16–18 and Comparative Example 9 are summarized in Table 5.

As shown in the Table, the fabric of the Comparative Example 11 exhibits poor strength properties reflecting insufficient entanglement due to use of greater amount of the low L/D fiber furnish. In addition there was observed a certain turbulence in surface fiber integrity and sheet formation. Drape and touch were also not satisfactory.

Evaluation data of the resulting fabric are summarized in Table 5 in comparison with other examples and comparative examples.

COMPARATIVE EXAMPLE 10

The procedure of Example 20 was repeated except that fiber length of the high L/D fiber was shifted to 20 mm (thereby making L/D ratio to 6700), and a nonwoven fabric was obtained. Fiber furnish constitution and other parameters of this Comparative Example are given in Table 4 in comparison with other examples and comparative examples. Evaluation data of the resulting fabric are summarized in Table 5 in comparison with other examples and comparative examples.

The precursor sheet obtained contained a lot of unseparated fiber mass and fiber bundles or strings reflecting difficulty in disintegrating and dispersing fibers having such high L/D ratio even if concentration of the fiber is lowered. Such fiber bundles or strings were formed assumedly during stirring of the fiber slurry prior to web formation. Due to presence of such fiber bundles or strings, fiber entanglement took place insufficiently, therefore resulted in poor strength properties, inferior sheet formation, and unsatisfactory touch and drape of the fabric.

EXAMPLE 21

The procedure of Example 18 was repeated except that fineness and fiber length of the high L/D fiber was shifted to 0.3 denier (diameter=5 pm) and 15 mm (thereby making L/D ratio to 3000), and a nonwoven fabric was obtained. Fiber furnish constitution and other parameters of this Example are given in Table 4 in comparison with other examples and comparative examples. Evaluation data of the resulting fabric are summarized in Table 5 in comparison with other examples and comparative examples.

TABLE 5

| | Basis Wt. | Density | Tensile kg/15 mm | | Stiffness | Pressure | Capt | Pore Size mm | | Sheet Touch Form'n | |
|---|---|---|---|---|---|---|---|---|---|---|---|
| | g/m$^2$ | g/cm$^3$ | MD | CD | mm | mmAq. | Eff. % | Max | MFP | — | — |
| Example | | | | | | | | | | | |
| 16 | 81.1 | 0.215 | 5.4 | 3.8 | 57 | 4.7 | 25.8 | 42 | 17 | ◎ | ◎ |
| 17 | 80.3 | 0.212 | 5.2 | 3.2 | 50 | 4.6 | 27.9 | 50 | 19 | ◎ | ◎ |
| 18 | 79.3 | 0.210 | 4.7 | 2.9 | 48 | 4.5 | 24.4 | 46 | 16 | ◎ | ◎ |
| 19 | 80.9 | 0.211 | 5.1 | 2.9 | 48 | 4.5 | 25.2 | 46 | 18 | ◎ | ◎ |
| 20 | 80.3 | 0.208 | 4.6 | 2.6 | 45 | 4.4 | 23.3 | 44 | 18 | ◎ | ◎ |
| 21 | 79.9 | 0.201 | 5.5 | 2.9 | 60 | 2.7 | 13.0 | 123 | 46 | ○ | ○ |
| Comparative Example | | | | | | | | | | | |
| 9 | 80.2 | 0.212 | 3.3 | 1.7 | 58 | 4.9 | 28.1 | 95 | 16 | ○ | ○ |
| 10 | 80.3 | 0.203 | 4.6 | 2.0 | 53 | 3.7 | 16.7 | 153 | 22 | X | Δ |
| 11 | 79.9 | 0.181 | 2.2 | 1.7 | 103 | 1.2 | 12.8 | — | 174 | X | X |

EXAMPLE 19

The procedure of Example 16 was repeated except that fiber length of the high L/D fiber was shifted to 7 mm (thereby making L/D ratio to 2300), its amount in the main fiber furnish to 85 parts, and the low L/D fiber to 15 parts, and a nonwoven fabric was obtained. Fiber furnish constitution and other parameters of this Example are given in Table 4 in comparison with other examples and comparative examples. Evaluation results of the resulting fabric are summarized in Table 5 in comparison with other examples and comparative examples.

EXAMPLE 20

The procedure of Example 16 was repeated except that fiber length of the high L/D fiber and the low L/D fiber was shifted to 15 mm (thereby making L/D ratio to 5000) and to 3 mm (thereby making L/D ratio to 1000) respectively, and their amount ratio, (high L/D fiber)/(low L/D fiber), to 20/80, and a nowoven fabric was obtained. Fiber furnish constitution and other parameters of this Example are given in Table 4 in comparison with other examples and comparative examples.

COMPARATIVE EXAMPLE 11

The procedure of Example 17 was repeated except that fineness and fiber length of the high L/D fiber was shifted to 1 denier (diameter=10 μm) and to 51 mm (thereby making L/D ratio to 5100), and a nonwoven fabric was obtained. Fiber furnish constitution and other parameters of this Comparative Example are given in Table 4 in comparison with other examples and comparative examples. Evaluation data of the resulting fabric are summarized in Table 5 in comparison with other examples and comparative examples.

The precursor sheet obtained contained a lot of unseparated fiber mass and fiber bundles or strings reflecting difficulty in disintegrating and dispersing such long fiber even though its L/D ratio falls within the range of the present invention. Such fiber bundles or strings were formed assumedly during stirring of the fiber slurry prior to web formation. Due to presence of such fiber bundles or strings, fiber entanglement took place insufficiently leaving huge pores in the fabric exceeding 300 μm unable to determine as maximum pore size by said testing method. The fabric obtained was poor in sheet formation, touch, drape and texture.

EXAMPLE 22

A fiber slurry was prepared using the same fiber furnish of Example 16 and exactly the same as that Example. The fiber slurry was laid to obtain a precursor sheet having basis weight of 82 g/m$^2$, and a single layer of that sheet was hydroentangled exactly as Example 16. Fiber furnish constitution and other parameters of this Example and evaluation data of the resulting fabric are given in Table 6 and Table 7 respectively.

EXAMPLE 23

2 sheets of the precursor web of Example 16 were stacked, and hydraulically entangled exactly as that Example except that water pressure of the primary, secondary and tertiary jet headers was regulated to 60, 65 and 75 kgf/cm$^2$ respectively. Further, another one precursor sheet of Example 16 was laid and hydroentangled exactly as Example 16 on a side that sheet was laid. Still further, one another precursor sheet of of Example 16 was laid on the other side and hydroentangled again. Fiber furnish constitution and other parameters of this Example and evaluation data of the resulting fabric are given in Table 6 and Table 7 respectively. It was confirmed that successful nonwoven fabrics can be obtained according to the present invention by changing stacking of precursor sheets and method of hydroentanglement.

EXAMPLE 24

Using the same main fiber furnish of Example 16, but without using the polyvinyl alcohol fiber, a precursor web of basis weight 82 g/m$^2$ was formed on the wet-laid former. The wet web, without drying, was immediately subjected to hydroentanglment on both sides, wherein water pressure applied to the primary, secondary and tertiary jet headers was 70, 90 and 100 kfg/cm$^2$ respectively.

EXAMPLE 25

The fabric of Example 16, right after hydroentanglement was put through 80° C. water to extract binder fiber component, then drained and dried exactly as Example 16. Fiber furnish constitution and other parameters of this Example and evaluation data of the resulting fabric are given in Table 6 and Table 7 respectively.

Using the same main fiber furnish of Example 16 and 6 parts a thermalbonding fiber based on 100 parts of the main fiber furnish, a fiber slurry was prepared, and from which a web having basis weight of 80 g/m$^2$ and dried. Fiber furnish constitution and other parameters of this Example and evaluation data of the resulting fabric are given in Table 6 and Table 7 respectively.

While the main furnish fibers are well qualified, the sheet as obtained was only wet-laid so that was dense and stiff lacking remarkably in texture and drape.

TABLE 6

| | Fiber Furnish | | |
|---|---|---|---|
| | High L/D Fiber parts in 100 parts | Low L/D Fiber parts in 100 parts | Nbr. of precursor sheets plied |
| Example | | | |
| 22 | 3 μmΦ × 10 mmL PET 70 | 3 mmΦ × 5 mmL PET 30 | 82 g/m$^2$ × 1 |
| 23 | 3 μmΦ × 10 mmL PET 70 | 3 mmΦ × 5 mmL PET 30 | 20.5 g/m$^2$ × 4*; *(intially 2, then (1 + 1) in addition |
| 24 | 3 μmΦ × 10 mmL PET 70 | 3 mmΦ × 5 mmL PET 30 | 82 g/m$^2$ × 1 (entangled on-line |
| 25 | 3 μmΦ × 10 mmL PET 70 | 3 mmΦ × 5 mmL PET 30 | 20.5 g/m$^2$ × 4, dipped in 80° C. water |
| Comparative Example | | | |
| 12 | 3 μmΦ × 10 mmL PET 70 | 3 mmΦ × 5 mmL PET 30 | 80 g/m$^2$, as laid (not entangled). |

TABLE 7

| | Basis Wt. | Density | Tensile kg/15 mm | | Stiffness | Pressure | Capt | Pore Size mm | | Sheet Touch Form'n | |
|---|---|---|---|---|---|---|---|---|---|---|---|
| | g/m$^2$ | g/cm$^3$ | MD | CD | mm | mmAq. | Eff. % | Max | MFP | — | — |
| Example | | | | | | | | | | | |
| 22 | 80.4 | 0.217 | 5.7 | 3.9 | 53 | 4.7 | 30.1 | 50 | 21 | ◎ | ◎ |
| 23 | 81.1 | 0.216 | 5.5 | 3.9 | 51 | 4.7 | 26.7 | 51 | 23 | ◎ | ◎ |
| 24 | 80.6 | 0.210 | 5.4 | 4.0 | 57 | 4.4 | 24.5 | 48 | 17 | ◎ | ◎ |
| 25 | 80.0 | 0.214 | 5.4 | 3.8 | 43 | 4.1 | 23.2 | 49 | 23 | ◎ | ◎ |
| Comparative Example | | | | | | | | | | | |
| 12 | 79.9 | 0.317 | 2.6 | 1.9 | 150 | 13.1 | NA | NA | Na | ◎ | X |

EXAMPLE 26

The procedure of Example 17 was repeated except that a polyacrylonitrile fiber, of which fineness is 0.1 denier (diameter=3.5 um) and length 10 mm (L/D=2900), was used in place of the high L/D fiber, and that a polyacrylonitrile fiber, of which fineness is 0.1 denier and length 6 mm (L/D=1700), was used in place of the low L/D fiber. In addition the dispersing agent was switched to an anionic type one which is suited for dispersing polyacrylonitrile fibers. Fiber furnish constitution and other parameters of this Example and evaluation data of the resulting fabric are given in Table 8 and Table 9 respectively.

The hydroentangled nonwoven fabric exhibited favorable drape, pleasing touch and texture. Using fibers of different material, a satisfactory nowoven fabric can be obtained.

EXAMPLE 27

2 sheets each of the 20 g/m$^2$ precursor sheet of Example 17 and same of Example 26, in total of 4, were stacked, and hydraulically entangled exactly as in Example 16. Fiber furnish constitution and other parameters of this Example and evaluation data of the resulting fabric are given in Table 8 and Table 9 respectively. It was confirmed that three-dimensional fiber entanglement takes place successfully between precursor sheets made of different material fibers.

EXAMPLE 28

The uniformly dispersed fiber slurry of Example 17 and same of Example 26 were mixed at ratio of 1/1 by weight. No coagulation or entwisting of fibers was effected by such mixing. The mixed fiber slurry thus prepared was formed into a 20 g/cm$^2$ web, of which 4 sheets were stacked and hydroentangled exactly as Example 17, and a hydroentangled nonwoven fabric was obtained. Fiber furnish constitution and other parameters of this Example and evaluation data of the resulting fabric are given in Table 8 and Table 9 respectively. It was confirmed that precursor sheets formed of mixed fibers of different material can make a successful nonwoven fabric.

EXAMPLES 29-31 AND COMPARATIVE EXAMPLE 13-15

Main fiber furnish consisted of a polyethylene terephthalate (PET) fiber, of which fineness is 0.1 denier, length 10 mm, diameter 3 μm, and L/D ratio 3300 as high L/D fiber, and an another PET fiber, of which fineness is 0.1 denier, length 5 mm, and L/D ratio 1700 as low L/D fiber. With these main furnish fibers, a sheath-core type polyester thermalbonding fiber (Melty 4080 manufactured by Unitika Co., melting point of the sheath being 110° C.) having fineness of 2 denier and length of 5 mm was made use of as a binder fiber.

Ratio of the high L/D fiber, low L/D fiber, and the binder fiber by weight (H/L/B ratio) was varied for the Examples 29-31 and Comparative Examples 13-15 as follows;

| | | H/L/B ratio |
|---|---|---|
| Example | 29 | 70/25/5 |
| | 30 | 50/45/5 |
| | 31 | 30/65/5 |
| Comparative Example | 13 | 5/90/5 |
| | 14 | 50/48/2 |
| | 15 | 50/20/30 |

The high L/D fiber was soaked in a 1% aqueous solution of an nonionic dispersing agent to make a fiber preparation. The low L/D fiber and binder fiber were disintegrated first in a pulper under relatively high rate agitation. The fiber slurry prepared was diluted with water, then transferred into a chest equipped with a reciprocating type impeller (Agitor, manufactured by Shimazaki Seisakusho Ltd.). Under a moderate stirring, said high L/D fiber preparation was added to the chest. Stirring rate was raised with a jerk for a few seconds and brought back moderate, and this procedure was repeated 3 times to disintegrate fibers thoroughly. Then, an aqueous solution of 1% polyacrylamide (as a viscosity modifier) was added quickly to the fiber slurry, and stirring rate was raised again and brought down to complete dispersion. The fiber slurry was laid

TABLE 8

| | Fiber Furnish | | |
|---|---|---|---|
| | High L/D Fiber parts in 100 parts | Low L/D Fiber parts in 100 parts | Nbr. of precursor sheets plied |
| Example | | | |
| 26 | 3.5 μmΦ × 10 mmL PAN 50 | 3.5 μmΦ × 6 mmL PAN 50 | 20 g/m$^2$ × 4 |
| 27 | 3 μmΦ × 10 mmL PET 50 | 3 μmΦ × 5 mmL PET 50 | 20.g/m$^2$ × 2 |
| | 3 μmΦ × 10 mmL PAN 50 | 3.5 μmΦ × 6 mmL PAN 50 | 20 g/m$^2$ × 2 (two each PET & PAN sheets) |
| 28 | 3 μmΦ × 10 mmL PET 50 | 3 μmΦ × 5 mmL PET 50 | 20 g/m$^2$ × 4 (formed of PET/PAN mixtr.) |
| | 3 μmΦ × 10 mmL PAN 50 | 3.5 μmΦ × 6 mmL PAN 50 | |

TABLE 9

| | Basis Wt. | Density | Tensile kg/15 mm | | Stiffness | Pressure | Capt | Pore Size mm | | Sheet Touch Form'n | |
|---|---|---|---|---|---|---|---|---|---|---|---|
| | g/m$^2$ | g/cm$^3$ | MD | CD | mm | mmAq. | Eff. % | Max | MFP | — | — |
| Example | | | | | | | | | | | |
| 26 | 80.6 | 0.210 | 5.2 | 2.8 | 48 | 4.5 | 24.6 | 52 | 23 | ◎ | ◎ |
| 27 | 80.7 | 0.211 | 5.3 | 2.8 | 52 | 4.5 | 27.7 | 53 | 23 | ◎ | ◎ |
| 28 | 80.2 | 0.211 | 5.5 | 3.9 | 52 | 4.6 | 24.1 | 52 | 20 | ◎ | ◎ |

on a Fourdrinier former and dried using a Yankee drier at 110° C. A PET precursor web having a width of 50 cm and basis weight 20.5 g/m$^2$ was obtained for each of Examples 16–18 and Comparative Example 13–15.

Four sheets of the thus obtained web for each of Examples 29–31 and Comparative Example 13–15 were stacked on a 100 mesh stainless steel wirecloth and subjected to a hydroentanglement processor having 3 water jets headers in series. The primary header had 2 rows of holes of which diameter was 120 pm and hole-to-hole distance was 1.2 mm and water pressure was maintained at 100 kgf/cm$^2$; the secondary header had a single row holes of which diameter 120 μm, hole-to-hole distance 0.6 mm, and water pressure at 100 kgf/cm$^2$; the tertiary header had a single row holes of which diameter 100 μm, hole-to-hole distance 0.6 mm, and water pressure at 120 kgf/cm$^2$. By letting the web stack with the wirecloth together under these headers, fibers were allowed to entangle. The fabric was then turned over, placed on the same wirecloth and hydroentangled similarly on the other side. Processing rate was kept 20 m/min both ways. The thus processed fabric was drained and dried using a suction through drier at 100° C. to make a hydroentangled nonwoven fabric. Fiber furnish constitution and other parameters of these Examples and Comparative Examples are given in Table 10; evaluation data of the resulting fabric are summarized in Table 11.

As shown in the Table, the fabric of the Comparative Example 13 exhibits poor strength properties reflecting insufficient entanglement due to use of greater amount of the low L/D fiber furnish. In addition there was observed a certain turbulence in surface fiber integrity and sheet formation. A precursor sheet of Comparative Example 14 failed to form a fiber integrity strong enough to be handled and processed for hydroentanglement due to use of too small amount of the binder fiber. On the other hand, fibers in the precursor sheet of Comparative Example 15 were fixed so firmly due to use of excessive amount of the binder fiber that the fabric obtained of it was not satisfactory in terms of inter-layer bond, drape and touch.

EXAMPLE 32

The procedure of Example 29 was repeated except that fiber length of the high L/D fiber was shifted to 7 mm (thereby making L/D ratio to 2300) and the H/L/B ratio to 80/15/5, and a nonwoven fabric was obtained. Fiber furnish constitution and other parameters of this Example are given in Table 10 and evaluation data of the resulting fabric in Table 11 in comparison with other examples and comparative examples.

EXAMPLE 33

The procedure of Example 29 was repeated except that fiber length of the high L/D fiber was shifted to 15 mm (thereby making L/D ratio to 5000) and the H/L/B ratio to 20/75/5, and a nowoven fabric was obtained. Fiber furnish constitution and other parameters of this Example are given in Table 10 and evaluation data of the resulting fabric in Table 11 in comparison with other examples and comparative examples.

COMPARATIVE EXAMPLE 16

The procedure of Example 33 was repeated except that fiber length of the high L/D fiber was shifted to 20 mm (thereby making L/D ratio to 6700). Fiber furnish constitution and other parameters of this Example are given in Table 10 and evaluation data of the resulting fabric in Table 11 in comparison with other examples and comparative examples.

The precursor sheet obtained contained a lot of unseparated fiber mass and fiber bundles or strings reflecting difficulty in disintegrating and dispersing fibers having such high L/D ratio even if concentration of the fiber is lowered. Due to presence of such fiber bundles or strings, fiber entanglement took place insufficiently, therefore resulted in poor strength properties, inferior sheet formation, and unsatisfactory touch and drape of the fabric.

EXAMPLE 34

The procedure of Example 31 was repeated except that fiber length of the high L/D fiber was shifted to 15 mm (thereby making L/D ratio to 5000), and a nowoven fabric was obtained. Fiber furnish constitution and other parameters of this Example are given in Table 10 and evaluation data of the resulting fabric in Table 11 in comparison with other examples and comparative examples.

COMPARATIVE EXAMPLE 17

The procedure of Example 30 was repeated except that fiber length of the high L/D fiber was shifted to 51 mm (thereby making L/D ratio to 5100), and a nowoven fabric was obtained. Fiber furnish constitution and other parameters of this Example are given in Table 10 and evaluation data of the resulting fabric in Table 11 in comparison with other examples and comparative examples.

The precursor sheet obtained contained a lot of unseparated fiber mass and fiber bundles or strings reflecting difficulty in disintegrating and dispersing such long fiber even though its L/D ratio falls within the range of the present invention. Such fiber bundles or strings were formed assumedly during stirring of the fiber slurry prior to web formation. Due to presence of such fiber bundles or strings, fiber entanglement took place insufficiently leaving huge pores in the fabric exceeding 300 μm unable to determine as maximum pore size by said testing method. The fabric obtained was poor in sheet formation, touch, drape and texture.

TABLE 10

| | Fiber Furnish | | | |
|---|---|---|---|---|
| | High L/D Fiber parts in 100 | Low L/D Fiber parts in 100 | Binder Fiber parts in 100 | Nbr. of precursor sheets plied |
| Example | | | | |
| 29 | 3 μmΦ × 10 mmL PET 70 | 3 μmΦ × 5 mmL PET 25 | Sheath-core PET 5 | 20 g/m$^2$ × 4 |
| 30 | 3 μmΦ × 10 mmL PET 50 | 3 μmΦ × 5 mmL PET 45 | Sheath-core PET 5 | 20 g/m$^2$ × 4 |
| 31 | 3 μmΦ × 10 mmL | 3 μmΦ × 5 mmL | Sheath-core | 20 g/m$^2$ × 4 |

TABLE 10-continued

| | Fiber Furnish | | | |
|---|---|---|---|---|
| | High L/D Fiber parts in 100 | Low L/D Fiber parts in 100 | Binder Fiber parts in 100 | Nbr. of precursor sheets plied |
| | PET 30 | PET 65 | PET 5 | |
| Comparative Example | | | | |
| 13 | 3 μmΦ × 10 mmL PET 5 | 3 μmΦ × 5 mmL PET 90 | Sheath-core PET 5 | 20 g/m² × 4 |
| 14 | 3 μmΦ × 10 mmL PET 50 | 3 μmΦ × 5 mmL PET 49.5 | Sheath-core PET 0.5 | 20 g/m² × 4 |
| 15 | 3 μmΦ × 10 mmL PET 50 | 3 μmΦ × 5 mmL PET 20 | Sheath-core PET 30 | 20 g/m² × 4 |
| Example | | | | |
| 32 | 3 μmΦ × 7 mmL PET 80 | 3 μmΦ × 5 mmL PET 15 | Sheath-core PET 5 | 20 g/m² × 4 |
| 33 | 3 μmΦ × 15 mmL PET 20 | 3 μmΦ × 3 mmL PET 75 | Sheath-core PET 5 | 20 g/m² × 4 |
| 34 | 5 μmΦ × 15 mmL PET 30 | 3 μmΦ × 5 mmL PET 655 | Sheath-core PET 5 | 20 g/m² × 4 |
| Comparative Example | | | | |
| 16 | 3 μmΦ × 20 mm PET 20 | 3 μmΦ × 3 mmL PET 75 | Sheath-core PET 5 | 20 g/m² × 4 |
| 17 | 10 μmΦ × 51 mmL PET 50 | 3 μmΦ × 5 mmL PET 45 | Sheath-core PET 5 | 20 g/m² × 4 |

TABLE 11

| | Basis Wt. | Density | Tensile kg/15 mm | | Stiffness | Pressure | Capt | Pore Size mm | | Sheet Touch Form'n | |
|---|---|---|---|---|---|---|---|---|---|---|---|
| | g/m² | g/cm³ | MD | CD | mm | mmAq. | Eff. % | Max | MFP | — | — |
| Example | | | | | | | | | | | |
| 29 | 81.1 | 0.215 | 5.4 | 3.8 | 59 | 4.6 | 25.8 | 42 | 17 | ◎ | ◎ |
| 30 | 80.3 | 0.212 | 5.2 | 3.2 | 50 | 4.6 | 27.9 | 51 | 19 | ◎ | ◎ |
| 31 | 79.3 | 0.210 | 4.7 | 2.9 | 48 | 4.5 | 24.4 | 46 | 16 | ◎ | ◎ |
| 32 | 80.9 | 0.211 | 5.1 | 2.9 | 49 | 4.5 | 25.2 | 46 | 18 | ◎ | ◎ |
| 33 | 80.3 | 0.208 | 4.6 | 2.6 | 45 | 4.4 | 23.3 | 45 | 19 | ◎ | ◎ |
| 34 | 79.9 | 0.201 | 5.5 | 2.9 | 60 | 2.7 | 13.0 | 123 | 46 | ◎ | ◎ |
| Comparative Example | | | | | | | | | | | |
| 14 | 80.2 | 0.212 | 3.3 | 1.7 | 58 | 4.9 | 28.1 | 95 | 16 | Δ | X |
| 15 | — | — | — | — | — | — | — | — | — | — | — |
| 16 | 80.3 | 0.200 | 5.5 | 3.5 | 102 | 6.9 | 30.1 | 81 | 10 | ○ | X |
| 17 | 80.3 | 0.203 | 4.6 | 2.0 | 53 | 3.7 | 16.7 | 153 | 22 | X | Δ |
| 18 | 79.9 | 0.181 | 2.2 | 1.7 | 103 | 1.2 | 12.8 | NA | 174 | X | X |

EXAMPLE 35

Using the same main fiber furnish of Example 29, except that the H/L/B ratio was changed to 20/75/5, a fiber slurry was prepared, and from which a web having basis weight of 80 g/m2 and dried. A single layer of this sheet was hydroentangled exactly as Example 29 except that water pressure of the primary, secondary and tertiary jet headers was regulated to 60, 65 and 75 kgf/cm² respectively. Fiber furnish constitution and other parameters of this Example and evaluation data of the resulting fabric are given in Table 12 and Table 13 respectively.

COMPARATIVE EXAMPLE 18

The precursor sheet of Example 35 as obtained was made to serve a nonwoven fabric and its properties evaluated as shown in Table 13.

While the main furnish fibers are well qualified, the sheet as obtained was only wet-laid so that was dense and stiff lacking remarkably in texture and drape.

EXAMPLE 36

The procedure of Example 30 was repeated except that the fabric after hydroenganglement was dried at 130° C. to make a hydroentangled nonwoven fabric. Fiber furnish constitution and other parameters of these Examples and Comparative Examples are given in Table 12; evaluation data of the resulting fabric are summarized in Table 13. The data shows that while drape degraded somewhat strength properties improved further.

EXAMPLE 37

2 sheets of the precursor web of Example 29 were stacked, and hydroentangled exactly as that Example except that water Pressure of the primary, secondary and tertiary jet headers was regulated to 60, 65 and 75 kgf/cm$^2$ respectively. Further, another one precursor sheet of Example 29 was laid and hydroentangled exactly as Example 29 on a side that sheet was laid. Still further, one another sheet of Example 29 was laid on the other side and hydroentangled again. Fiber furnish constitution and other parameters of this Example and evaluation data of the resulting fabric are given in Table 12 and Table 13 respectively.

TABLE 12

| | Fiber Furnish | | | |
|---|---|---|---|---|
| | High L/D Fiber parts in 100 | Low L/D Fiber parts in 100 | Binder Fiber parts in 100 | Nbr. of precursor sheets plied |
| Example | | | | |
| 35 | 3 μmΦ × 10 mmL PET 70 | 3 μmΦ × 5 mmL PET 25 | Sheath-core PET 5 | 80 g/m$^2$ × 1 |
| 36 | 3 μmΦ × 10 mmL PET 50 | 3 μmΦ × 5 mmL PET 45 | Sheath-core PET 5 | 80 g/m$^2$ × 1 (dried 130° C.) |
| 37 | 3 μmΦ × 10 mmL PET 70 | 3 μmΦ × 5 mmL PET 25 | Sheath-core PET 5 | 20 g/m$^2$ × 2 plus (1 + 1) × 20 g/m$^2$ × 2 |
| 38 | 3 μmΦ × 10 mmL PET 70 | 3 μmΦ × 5 mmL PET 20 | Sheath-core PO 10 | 20 g/m$^2$ × 4 |
| Comparative Example | | | | |
| 18 | 3 μmΦ × 10 mmL PET 70 | 3 μmΦ × 5 mmL PET 25 | Sheath-core PET 5 | 80 g/m$^2$ × 1 not hydroentangled |

It was confirmed that successful nonwoven fabrics can be obtained according to the present invention by changing stacking of precursor sheets and method of hydroentanglement.

EXAMPLE 38

The procedure of Example 29 was repeated except that the binder fiber was replaced with a polyolefin (PO) sheath-core type thermalbonding fiber (ES Fibre, manufactured by Chisso Co.) having fineness of 1.5 denier and length of 5 mm was used and that the H/L/B ratio was changed to 70/20/10. Fiber furnish constitution and other parameters of this Example are given in Table 12; evaluation data of the resulting fabric are summarized in Table 13. The data shows that a successful nonwoven fabric can be obtained by changing the binder fiber.

TABLE 13

| | Basis Wt. g/m$^2$ | Density g/cm$^3$ | Tensile kg/15 mm MD | Tensile kg/15 mm CD | Stiffness mm | Pressure mmAq. | Capt Eff. % | Pore Size mm Max | Pore Size mm MFP | Sheet Touch Form'n — | Sheet Touch Form'n — |
|---|---|---|---|---|---|---|---|---|---|---|---|
| Example | | | | | | | | | | | |
| 35 | 80.4 | 0.217 | 5.7 | 3.9 | 55 | 4.7 | 30.1 | 50 | 21 | ◎ | ◎ |
| 36 | 80.6 | 0.210 | 6.8 | 4.4 | 65 | 4.4 | 24.5 | 49 | 17 | ◎ | ○ |
| 37 | 81.1 | 0.216 | 5.5 | 3.9 | 52 | 4.7 | 26.7 | 51 | 25 | ◎ | ◎ |
| 38 | 81.0 | 0.207 | 5.3 | 2.8 | 49 | 4.1 | 23.3 | 49 | 23 | ◎ | ◎ |
| Comparative Example | | | | | | | | | | | |
| 18 | 79.9 | 0.317 | 2.6 | 1.9 | 150 | 13.1 | — | — | — | ◎ | X |

EXAMPLE 39

The procedure of Example 30 was repeated except that a polyacrylonitrile (PAN) fiber, of which fineness is 0.1 denier (diameter=3.5 pm) and length 10 mm (L/D=2900), was used in Place of the high L/D fiber, and that a polyacrylonitrile fiber, of which fineness is 0.1 denier and length 6 mm (L/D=1700), was used in place of the low L/D fiber. In addition the dispersing agent was switched to an anionic type one which is suited for dispersing acrylonitrile fibers. Fiber furnish constitution and other parameters of this Example and evaluation data of the resulting fabric are given in Table 14 and Table 15 respectively. The hydroentangled nonwoven fabric exhibited favorable drape, pleasing touch and texture.

EXAMPLE 40

2 sheets each of the 20 g/m$^2$ precursor sheet of Example 30 and same of Example 39, in total of 4, were stacked, and hydraulically entangled exactly as in Example 29. Fiber furnish constitution and other parameters of this Example and evaluation data of the resulting fabric are given in Table 14 and Table 15 respectively. It was confirmed that three dimensional fiber entanglement takes place successfully between precursor sheets made of different material fibers.

EXAMPLE 41

The uniformly dispersed fiber slurry of Example 30 and same of Example 39 were mixed at ratio of 1/1 by weight. No coagulation or entwisting of fibers was effected by such mixing. The mixed fiber slurry thus prepared was formed into a 20 g/cm$^2$ web, of which 4 sheets were stacked and hydroentangled exactly as Example 29, and a nonwoven fabric was obtained. Fiber furnish constitution and other parameters of this Example and evaluation data of the resulting fabric are given in Table 14 and Table 15 respectively. It was confirmed that precursor sheets formed of mixed fibers of different material can make a successful nonwoven fabric.

TABLE 14

| | Fiber Furnish | | | |
|---|---|---|---|---|
| | High L/D Fiber parts in 100 | Low L/D Fiber parts in 100 | Binder Fiber parts in 100 | Nbr. of precursor sheets plied |
| Example | | | | |
| 39 | 3 μmΦ × 10 mmL PAN 50 | 3.5 μmΦ × 6 mmL PAN 45 | Sheath-core PET 5 | 20 g/m² × 4 |
| 40 | 3 μmΦ × 10 mmL PET 50 | 3 μmΦ × 5 mmL PET 45 | Sheath-core PET 5 | 20 g/m² × 2 plus |
| | 3 μmΦ × 10 mmL PAN 50 | 3 μmΦ × 5 mmL PAN 45 | Sheath-core PET 5 | 20 g/m² × 2 4 in total |
| 41 | 3 μmΦ × 10 mmL PET 50 | 3 μmΦ × 5 mmL PET 45 | Sheath-core PET 5 | 20 g/m² × 4 (formed of PET/PAN mixtr.) |
| | 3 μmΦ × 10 mmL PAN 50 | 3 μmΦ × 5 mmL PAN 45 | Sheath-core PET 5 | |

TABLE 15

| | Basis Wt. | Density | Tensile kg/15 mm | | Stiffness | Pressure | Capt | Pore Size mm | | Sheet Touch Form'n | |
|---|---|---|---|---|---|---|---|---|---|---|---|
| | g/m² | g/cm³ | MD | CD | mm | mmAq. | Eff. % | Max | MFP | — | — |
| Example | | | | | | | | | | | |
| 39 | 80.6 | 0.210 | 5.2 | 2.8 | 48 | 4.5 | 24.6 | 52 | 24 | ◎ | ◎ |
| 40 | 80.7 | 0.211 | 5.3 | 2.8 | 53 | 4.5 | 27.7 | 53 | 23 | ◎ | ◎ |
| 41 | 80.2 | 0.211 | 5.5 | 3.9 | 52 | 4.6 | 24.1 | 52 | 20 | ◎ | ◎ |

What is claimed is:

1. A nonwoven fabric having good sheet formation comprising fibers whose diameter is 7 μm of less, whose length (L) to diameter (D) ratio is within the range of $2000 < L/D \leqq 6000$, and wherein the fibers are three-dimensionally entangled.

2. The nonwoven fabric according to claim 1 in which thermalbonding fibers are additionally contained as binder fibers.

3. The nonwoven fabric according to claim 1 in which the diameter of the fibers is 1–5 μm.

4. A nonwoven fabric having good sheet formation comprising fibers whose diameter is 7 μm or less and which are three-dimensionally entangled, and wherein the size of the pores in the nonwoven fabric is such that the maximum pore size is 5 times or less the mean pore size.

5. The nonwoven fabric according to claim 4 in which the fibers comprise 10–90% by weight based on the nonwoven fabric of fibers whose diameter is 7 μm or less and whose length to diameter ratio (L/D) is less than 2000, and 90–10% by weight based on the nonwoven fabric of fibers whose diameter is 7 μm or less and whose length to diameter ratio (L/D) is within the range of $2000 < L/D \leqq 6000$.

6. The nonwoven fabric according to claims 4 or 5 in which thermalbonding fibers are additionally contained as binder fibers.

7. The nonwoven fabric according to claim 1 in which the diameter of the fibers is less than 7 μm.

8. The nonwoven fabric according to claim 4 in which the diameter of the fibers is less than 7 μm.

* * * * *